US007117795B2

(12) United States Patent
Schultze et al.

(10) Patent No.: US 7,117,795 B2
(45) Date of Patent: Oct. 10, 2006

(54) METHOD AND DEVICE FOR CORRECTING THE POSITIONAL DEVIATION OF A CONVEYED ITEM BY ADJUSTING THE CYLINDER'S ANGLE ROTATION RELATIVE TO THE CONVEYED ITEM

(75) Inventors: Stephan Schultze, Lohr (DE); Hans-Juergen Doeres, Frammersbach (DE)

(73) Assignee: Rexroth Indramat GmbH, Lohr am Main (DE)

( * ) Notice: Subject to any disclaimer, the term of this patent is extended or adjusted under 35 U.S.C. 154(b) by 0 days.

(21) Appl. No.: 11/013,107

(22) Filed: Dec. 15, 2004

(65) Prior Publication Data

US 2005/0132918 A1 Jun. 23, 2005

(30) Foreign Application Priority Data

Oct. 20, 2003 (DE) ..... 103 60 168

(51) Int. Cl.
*B41F 1/34* (2006.01)
*B65H 7/02* (2006.01)

(52) U.S. Cl. ..... 101/485; 271/228

(58) Field of Classification Search ..... 101/485; 271/226–228, 265.01; 347/104, 19; 399/49, 399/51; 388/394; 358/1.19; 382/162
See application file for complete search history.

(56) References Cited

U.S. PATENT DOCUMENTS 3,754,755 A * 8/1973 Krochert ..... 271/236
3,789,203 A * 1/1974 Catherall et al. ..... 708/290
4,031,370 A * 6/1977 Catherall ..... 708/290
4,060,237 A * 11/1977 Degen et al. ..... 271/231
4,351,027 A * 9/1982 Gay et al. ..... 701/116
4,415,286 A * 11/1983 Jennings ..... 400/279
4,688,708 A * 8/1987 Irvine et al. ..... 225/100
4,831,420 A * 5/1989 Walsh et al. ..... 399/16
5,096,183 A * 3/1992 Hauck et al. ..... 271/227
5,100,120 A * 3/1992 Kikuchi et al. ..... 271/22
5,117,365 A * 5/1992 Jeschke et al. ..... 700/124
5,357,860 A * 10/1994 Shibata et al. ..... 101/248
5,613,675 A * 3/1997 Kruger et al. ..... 271/270
5,632,478 A * 5/1997 Quesnel et al. ..... 271/242
5,947,469 A 9/1999 Henn et al. ..... 271/228
6,126,345 A * 10/2000 Ito et al. ..... 400/624
6,331,751 B1 * 12/2001 Kwak et al. ..... 313/402
6,332,397 B1 * 12/2001 Bolza-Schunemann et al. .. 101/183
6,473,572 B1 * 10/2002 Uchiyama et al. ..... 399/24
6,532,869 B1 * 3/2003 Aoyama et al. ..... 101/177
6,556,367 B1 * 4/2003 Takahashi ..... 360/67
6,872,280 B1 * 3/2005 Tanaka et al. ..... 156/345.12
6,888,961 B1 * 5/2005 Tamagawa et al. ..... 382/162
6,920,292 B1 * 7/2005 Metzler ..... 399/51
2001/0001585 A1 * 5/2001 Takahashi ..... 360/77.08
2004/0125711 A1 * 7/2004 Sato et al. ..... 369/44.32

FOREIGN PATENT DOCUMENTS

DE 004201682 * 1/1992
DE 44 44 755 A1 8/1995

(Continued)

*Primary Examiner*—Ren Yan
*Assistant Examiner*—Wasseem H. Hamdan
(74) *Attorney, Agent, or Firm*—Michael J. Striker

(57) ABSTRACT

To correct the position of a conveyed item (12) in a conveyance system (10), the deviation of the conveyed item (12) from its target position is detected. If this deviation reveals that a correction is necessary, a suitable correction profile Pi is selected from a plurality of available correction profiles (P1, P2, P3), and the correction is carried out.

9 Claims, 2 Drawing Sheets

FOREIGN PATENT DOCUMENTS

| | | | |
|---|---|---|---|
| DE | 44 36 034 | A1 | 4/1996 |
| DE | 195 09 468 | A1 | 9/1996 |
| EP | 0 753 407 | A2 | 1/1997 |
| JP | 2000168053 | * | 6/2000 |
| JP | 2003-062969 | * | 3/2003 |

* cited by examiner

METHOD AND DEVICE FOR CORRECTING THE POSITIONAL DEVIATION OF A CONVEYED ITEM BY ADJUSTING THE CYLINDER'S ANGLE ROTATION RELATIVE TO THE CONVEYED ITEM

CROSS-REFERENCE

The invention described and claimed hereinbelow is also described in DE 103 60 168.6, filed Dec. 20, 2003. This German Patent Application, whose subject mater is incorporated here by reference, provides the basis for a claim of priority of invention under 35 U.S.C. 119 (a)–(d).

BACKGROUND OF THE INVENTION

The present invention relates to a method for correcting the positional deviation of a conveyed item in a conveyance system, in particular a sheet or a material web, and a device for correcting the positional deviation of a conveyed item.

When conveying objects, in particular sheets, material webs or other goods to be conveyed, it is often necessary to hold the conveyed items in a defined position, to correct their position relative to the conveyance system, or to adjust downstream stations, in particular processing stations, to the current position of the conveyed items. To ensure this, the actual position of the conveyed item is usually detected and compared with a target value. If deviations are identified, correction of the position of the conveyed item is initiated, for example. For example, general conveyance procedures in "in-line" conveyance machines, i.e., in cyclical machines with a recurrent production process, corrections of the position of the conveyed item itself, or corrections of a downstream processing station can be carried out in the machine. After a positional deviation is detected, the conveyance procedure is corrected by superimposing a correcting motion on the synchronous machine operation.

A further example of this can be seen in the register control for printing processes in sheetfed printing. In this process, the position of the sheet on impression cylinder 16 can be adjusted such that it has precise register. By maintaining precise register, it can be guaranteed that the impression zones of the different colors are positioned exactly.

For this purpose, ink or another marking applied separately to the printing stock can be scanned. Based on the sampled value determined in this manner, the current actual position value of the printing stock can be determined using a time or location-based method of evaluating the current actual position value of the printing stock, for example. By making a comparison with a target value, a deviation can be identified which must be corrected in order to process the printing stock with positional accuracy in a downstream processing step. Processing steps of this nature can include an additional application of ink, cutting the printing stock, embossing or folding, for example. To perform the correcting motion, a correcting motion can be superimposed on the synchronous machine operation of the downstream processing unit.

As known from EP 753 407 A2, for example, the lateral alignment of a sheet in a printing press can be corrected. To this end, a positional deviation of the side edge of the sheet from the target value is first determined using a target vs. actual comparison of measured value. The sheet is then brought into the target position using a correcting motion.

In performing corrections of this type, the correction path is the path along which the conveyed item moves in the transport direction while the correcting motion is being carried out. The overall, superimposed travel carried out which therefore corresponds to the duration of the correction action, is referred to as the correction. If, in an x-y diagram, the correction path is plotted on the x-axis and the correction is plotted on the y-axis, a graphic representation results which is referred to as the correction profile. In terms of performing corrections, a defined correction profile is permanently specified in machines used today to convey sheets, such as printing presses, post-printing finishing machines such as folding machines or other machines for transporting conveyed items. These permanently specified correction profiles are therefore not adaptable to different applications or even different machine types.

SUMMARY OF THE INVENTION

The object of the present invention, therefore, is to propose a method for correcting the position of a conveyed item which is usable with different applications and machine types.

This object is attained, according to the present invention, using a method for correcting the position of a conveyed item. With regard for the device, the means of attaining the object of the invention is a device for correcting the position of a conveyed item.

By providing a selectable profile, it is possible to prevent unfavorable correction profiles and resultant unfavorable correction motions for the various applications and machine types, because, according to the present invention, a correction profile appropriate for the situation can now be selected. With the possibility of selecting a suitable correction profile, the correction can be carried out such that it is carried out in a manner that is easy on the machine.

In an embodiment of the present invention, the plurality of correction profiles is stored, in particular selectively stored, in the control system of the conveyance system. In a further embodiment of the present invention, the correction profile can be selected by the operator in advance for the upcoming conveyance procedure.

A further embodiment of the present invention makes it possible to automatically select the suitable correction profile from the plurality of stored correction profiles using the control system according to predetermined criteria. One of these criteria can be the current or predetermined conveyance speed.

Furthermore, the plurality of selectable, stored correction profiles can contain at least one that is asymmetrical. This asymmetry is achieved, for example, by the fact that the acceleration procedure is slower than that of a symmetric profile, i.e., it is "gentler", and the braking procedure is more abrupt.

It is also advantageous when the selectable correction profiles can be specified or changed by the operator. Tables of supporting points which can be set up by the operator to define the correction profiles are particularly suited for this purpose. It is also possible to provide the correction profiles such that they can be specified by the operator using changeably specified coefficients of a polynomial expression and/or changeably specified coefficients of any specified function. Functions to consider include combinations of polynomial expressions or sine functions, for example.

In a further advantageous configuration of the invention, the selectable correction profiles are designed such that the suitable correction profile can be switched by the operator or automatically while the conveyance system is operating. With this possibility, the particular correction profile being used can be adapted to the current conveyance conditions, e.g., to the current speed of the conveyed item. Further advantages and advantageous embodiments of the present invention are the subject of the following figures and their descriptions.

Figure 1:
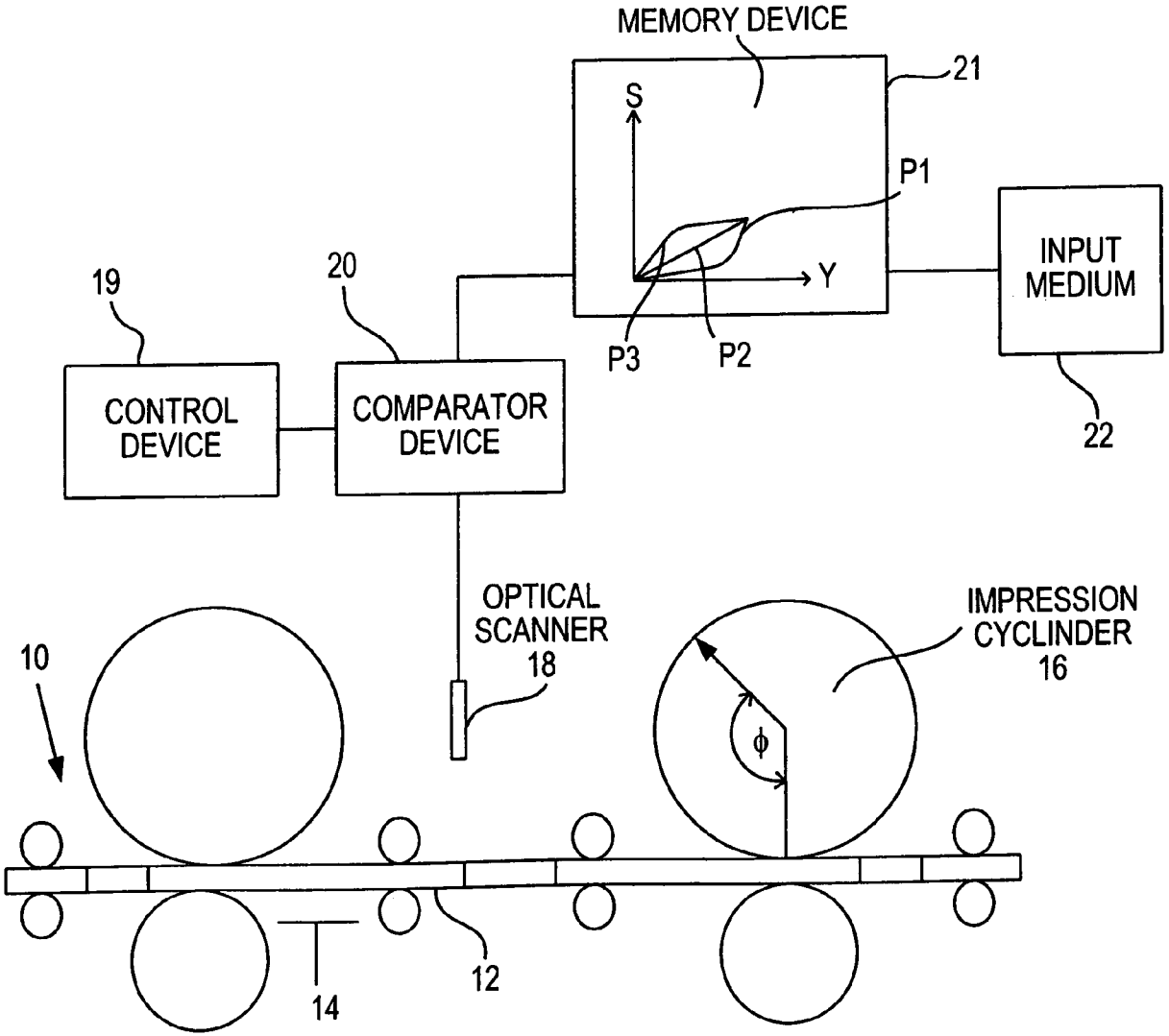
FIG. 1 shows a schematic depiction of a conveyance system with a device, according to the present invention, for correcting the position of a conveyed item.

| Reference numerals | |
|---|---|
| 10 | Conveyance system |
| 12 | Sheet |
| 14 | Conveyance system |
| 16 | Printing unit |
| 18 | Optical scanner |
| 19 | Control device |
| 20 | Comparator device |
| 21 | Memory device |
| 22 | Input medium |
| 24 | Detection of the actual position |
| 26 | Check to determine if correction is necessary |
| 28 | Load correction profile |
| 30 | Automatic or manual profile selection |
| P1 | Selectable correction profile |
| P2 | Selectable correction profile |
| P3 | Selectable correction profile |
| $P_i$ | Suitable correction profile |

DESCRIPTION OF THE PREFERRED EMBODIMENTS

A conveyance system 10 is shown schematically in FIG. 1. Conveyance system 10 is shown, for example purposes, as a sheet-conveying device in a web offset press. The conveyed item, i.e., sheet 12, is moved in the conveyance system and conveyed to a processing station, an impression cylinder 16 as shown in FIG. 1. Other processing stations can be provided, of course, such as a cutting machine or a perforating machine. Conveyance to impression cylinder 16 must take place with precise register, i.e., in a manner such that processing takes place in the exact, intended location on the sheet. Precise register is required with color printing in particular, to ensure exact color reproduction. To ensure this, a position detection device is provided upstream of impression cylinder, e.g., in the form of an optical scanner 18. Optical scanner 18 can detect the position of sheet 12 based on specified criteria. They include, in particular, detection of the printed image itself, separate position markings or the edge of sheet 12.

After the position of sheet 12 is detected, the current actual position of sheet 12 or a variable corresponding thereto is known. It can now be compared in a comparator device 20 with a stored target value. Based on the comparison, it can be determined whether it is necessary to correct the position of sheet 12. This is typically the case when the deviation between the target and actual value exceeds a predetermined value.

Basically, there are two possibilities for performing corrections, whereby the two methods may also be mixed, i.e., they can be combined with each other such that the necessary overall correction is achieved. To this end, the position of sheet 12 can be moved into the target position, e.g., with the aid of a system of actuators. As an alternative, the position and/or movement of the downstream printing unit can be adjusted to the actual position of the sheet. If both correction procedures are used, only a portion of the necessary correction will be carried out by moving the sheet toward the target value. The remaining value is achieved by making a correspondingly small adjustment to impression cylinder 16 or by moving impression cylinder 16.

In printing presses, there are typically few possibilities for influencing the position of sheet 12, at least not when sheet 12 is already located inside the printing press and is being conveyed toward an impression cylinder 16. In this case, correction therefore takes place solely by adjusting impression cylinder 16 to the measured actual position of sheet 12. As shown in FIG. 1, the correction must be completed when sheet 12 contacts impression cylinder 16. For this reason, the correction must take place within a certain range of the angle of rotation of impression cylinder 16. The necessary movement is represented by a "correction profile" which is given by the functional relationship between correction path s and angle of rotation $\phi$ within which the correction must be carried out. Since the correction profiles differ depending on the type of machine and processing device, a plurality of correction profiles P1, P2, P3 is stored in a memory device 21, from which a suitable correction profile can then be selected in order to carry out the correction. The memory device can be connected with control device 19 of conveyance system 10, or it can be integrated therein.

To carry out the correction, the suitable correction profile $P_i$ is used and the resultant correcting motion is superimposed on the motion of impression cylinder 16, which is typically a function of the synchronous machine operation. For a certain machine constellation and application, the operator can specify a suitable correction profile from the plurality of available profiles P1, P2, P3. The suitable profile $P_i$ can also be specified automatically based on certain machine data which are determined automatically. It is also advantageous if the operator or conveyance system 10 itself selects the suitable correction profile from the plurality of correction profiles P1, P2, P3 in accordance with the particular operating condition. For example, a speed-dependent selection can be realized which, in turn, ensures a more exact positioning for different application states.

The plurality of correction profiles P1, P2, P3 can be stored as a table, for example, in memory device 21, so that a suitable correction table can be loaded by the machine control system. If the tables are specifiable by the operator, a further degree of freedom is achieved. To this end, the operator is provided with the possibility, via an input medium 22, of processing the table of supporting points and changing the requirements accordingly. Of course, a further possibility to be created is that of changing the correction table in another manner or to replace it altogether by loading a new table or all tables or table values via external data access into the machine control system, for example.

The stored correction profiles P1, P2 and P3 can have different forms. They can be linear, exponential or sinusoidal, in particular. It is also possible to design the correction profiles asymmetrical in shape, so that braking and acceleration procedures take place at different speeds. For example, acceleration can be carried out at a high rate of speed, while braking is carried out at a low rate of speed.

Figure 2:
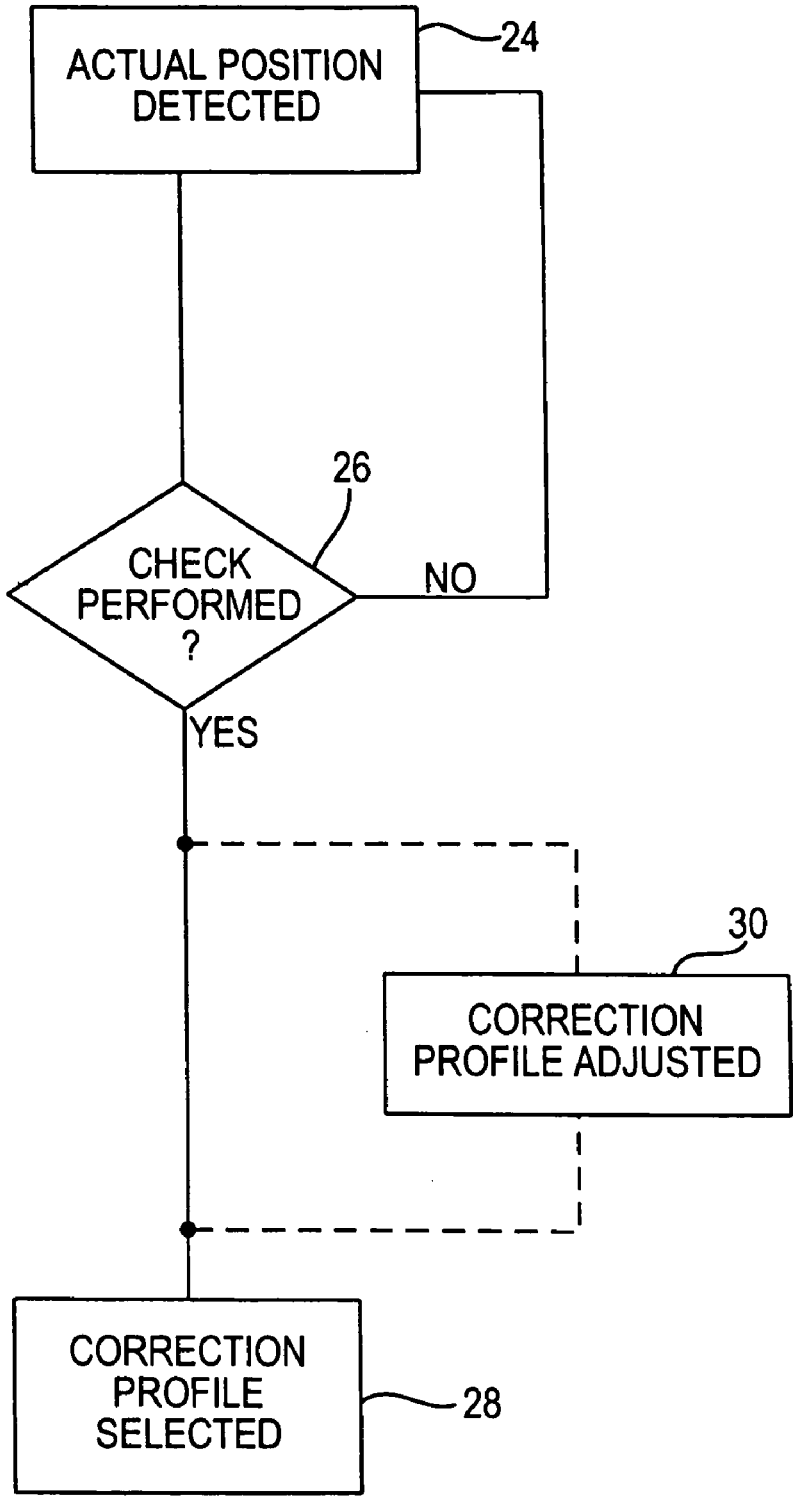
FIG. 2 shows, schematically, the sequence of steps of the method, according to the present invention, for correcting the position of a conveyed item.

FIG. 2 illustrates the procedural sequence according to the present invention once more, in the form of a flow chart. First, the actual position of a conveyed item is detected in a first step 24. In step 26, a check is run to determine whether a correction is required, based on the determined actual value and a specified target value. If a correction is not required, the actual value of the next conveyed item is detected. If the deviation between the target and actual value is so great that a correction is necessary, however, the correction profile which is suitable for the particular application and machine being used can be selected from a plurality of correction profiles in step 28. As indicated by the dashed line, a further step 30 can be carried out before step 28. In this step, at least one of the stored correction profiles P1, P2, P3 is adjusted automatically or manually, e.g., by modifying a stored table of supporting points. In step 28, the selection can take place just one time for the entire processing procedure, i.e., practically for the entire print job. With fluctuations of the operating parameters in particular, e.g., if the transport speed changes, a correction table suitable for the particular situation can also be loaded multiple times during the machine run. The selection of the suitable correction profile from the plurality of stored correction profiles P1, P2, P3 can therefore also take place during machine operation based on specified current machine parameters, such as the current speed, acceleration or other parameters.

Although the mode of operation was described with reference to a sheetfed press, the present invention is not limited to this special case of a conveyance system with a processing station. Rather, the present invention can be used with any conveyance system with which a defined orientation of the conveyed item relative to a processing station is desired.

The invention claimed is:

1. A method for correcting the positional deviation of a conveyed item (12) in a conveyance system (10), in particular a sheet or a material web in a printing press, whereby the deviation of the conveyed item (12) from its target position is detected and, based on the deviation, a correction is carried out with the aid of a correction profile (P1, P2, P3), wherein the correction profile comprises a functional relationship between a correction path and an angle of rotation of the impression cylinder relative to a measured actual position of the conveyed item, wherein the correction must be carried out within said correction profile, and wherein a suitable correction profile ($P_i$) is selected from a plurality of selectable correction profiles (P1, P2, P3).

2. The method as recited in claim 1, wherein the plurality of selectable correction profiles (P1, P2, P3) is stored in a selectable manner, in particular in the control system of the conveyance system (10).

3. The method as recited in claim 1, wherein the suitable correction profile ($P_i$) is selected by an operator in advance for the conveyance procedure.

4. The method as recited in claim 1, wherein the suitable correction profile ($P_i$) is selected by the control device (19) of the conveyance system (10) according to predetermined criteria.

5. The method as recited in claim 1, wherein an asymmetric correction profile ($P_i$) is selected as the suitable profile.

6. The method as recited in claim 1, wherein at least one of the selectable correction profiles (P1, P2, P3) is specified by an operator in the form of a table of supporting points.

7. The method as recited in claim 6, wherein at least one of the selectable correction profiles (P1. P2, P3) is specified by the operator using changeably specified coefficients of a polynomial expression and/or by changeable specified coefficients of any function.

8. The method as recited in claim 1, wherein the suitable correction profile ($P_i$) is changed while the conveyance system (10) is operating, either by an operator or automatically.

9. The method as recited in claim 8, wherein the change in the correction profile depends on the speed of the conveyed item (12).

* * * * *